US010771877B2

(12) United States Patent
Dragicevic et al.

(10) Patent No.: US 10,771,877 B2
(45) Date of Patent: Sep. 8, 2020

(54) DUAL EARPIECES FOR SAME EAR

(71) Applicant: BRAGI GmbH, Münich (DE)

(72) Inventors: Darko Dragicevic, Munich (DE); Peter Vincent Boesen, Munich (DE)

(73) Assignee: BRAGI GmbH, Munich (DE)

( * ) Notice: Subject to any disclaimer, the term of this patent is extended or adjusted under 35 U.S.C. 154(b) by 33 days.

(21) Appl. No.: 15/799,992

(22) Filed: Oct. 31, 2017

(65) Prior Publication Data

US 2018/0124491 A1 May 3, 2018

Related U.S. Application Data

(60) Provisional application No. 62/414,973, filed on Oct. 31, 2016.

(51) Int. Cl.

| | |
|---|---|
| ***H04R 25/00*** | (2006.01) |
| ***H04R 1/10*** | (2006.01) |
| ***H04R 1/02*** | (2006.01) |
| ***H04R 1/08*** | (2006.01) |
| *H04R 5/033* | (2006.01) |

(52) U.S. Cl.

CPC ..... *H04R 1/1016* (2013.01); *H04R 1/026* (2013.01); *H04R 1/08* (2013.01); *H04R 1/1041* (2013.01); *H04R 1/1058* (2013.01); *H04R 5/033* (2013.01); *H04R 2201/029* (2013.01); *H04R 2420/07* (2013.01); *H04R 2460/03* (2013.01); *H04R 2460/13* (2013.01)

(58) Field of Classification Search

CPC ... H04R 1/1025; H04R 1/1066; H04R 1/1033

USPC ..... 381/380

See application file for complete search history.

(56) References Cited

U.S. PATENT DOCUMENTS

| | | | |
|---|---|---|---|
| 2,325,590 | A | 8/1943 | Carlisle et al. |
| 2,430,229 | A | 11/1947 | Kelsey |
| 3,047,089 | A | 7/1962 | Zwislocki |
| D208,784 | S | 10/1967 | Sanzone |
| 3,586,794 | A | 6/1971 | Michaelis |
| 3,934,100 | A | 1/1976 | Harada |
| 3,983,336 | A | 9/1976 | Malek et al. |

(Continued)

FOREIGN PATENT DOCUMENTS

| | | | |
|---|---|---|---|
| CN | 204244472 | U | 4/2015 |
| CN | 104683519 | A | 6/2015 |

(Continued)

OTHER PUBLICATIONS

Wikipedia, "Wii Balance Board", "https://en.wikipedia.org/wiki/Wii_Balance_Board", 3 pages, (Jul. 20, 2017).

(Continued)

*Primary Examiner* — Phylesha Dabney

(74) *Attorney, Agent, or Firm* — Goodhue, Coleman & Owens, P.C.

(57) ABSTRACT

A system, method and device for a set of wireless earpieces anatomically conformed for wearing in the same ear is disclosed. Each wireless earpiece includes an earpiece housing, a speaker disposed within the earpiece housing, a memory device disposed within the earpiece housing, a transceiver disposed within each earpiece housing; and a processor disposed within each earpiece housing and operatively connected to the speaker and the transceiver.

13 Claims, 6 Drawing Sheets

(56) References Cited

U.S. PATENT DOCUMENTS 4,069,400 A 1/1978 Johanson et al.
4,150,262 A 4/1979 Ono
4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Arndt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,208,372 B1 3/2001 Barraclough
6,230,029 B1 5/2001 Yegiazaryan et al.
6,275,789 B1 8/2001 Moser et al.
6,339,754 B1 1/2002 Flanagan et al.
D455,835 S 4/2002 Anderson et al.
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
D601,134 S 9/2009 Elabidi et al.
7,825,626 B2 11/2010 Kozisek
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
D666,581 S 9/2012 Perez
8,300,864 B2 10/2012 Mallenborn et al.
8,406,448 B2 3/2013 Lin et al.
8,436,780 B2 5/2013 Schantz et al.
D687,021 S 7/2013 Yuen
8,719,877 B2 5/2014 VonDoenhoff et al.
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,510,159 B1 11/2016 Cuddihy et al.
D773,439 S 12/2016 Walker
D775,158 S 12/2016 Dong et al.
D777,710 S 1/2017 Palmborg et al.
9,544,689 B2 1/2017 Fisher et al.
D788,079 S 5/2017 Son et al.
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen
2005/0165663 A1 7/2005 Razumov
2005/0196009 A1 9/2005 Boesen
2005/0251455 A1 11/2005 Boesen
2005/0266876 A1 12/2005 Boesen

(56) References Cited

U.S. PATENT DOCUMENTS

2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0220915 A1 10/2006 Bauer
2006/0258412 A1 11/2006 Liu
2007/0104343 A1* 5/2007 Bengtsson ..... H04R 25/305 381/323
2007/0195979 A1* 8/2007 Thomasson ..... H04R 25/558 381/316
2008/0076972 A1 3/2008 Dorogusker et al.
2008/0090622 A1 4/2008 Kim et al.
2008/0146890 A1 6/2008 LeBoeuf et al.
2008/0187163 A1 8/2008 Goldstein et al.
2008/0253583 A1 10/2008 Goldstein et al.
2008/0254780 A1 10/2008 Kuhl et al.
2008/0255430 A1 10/2008 Alexandersson et al.
2008/0298606 A1* 12/2008 Johnson ..... H04R 1/1091 381/74
2009/0003620 A1 1/2009 McKillop et al.
2009/0008275 A1 1/2009 Ferrari et al.
2009/0017881 A1 1/2009 Madrigal
2009/0073070 A1 3/2009 Rofougaran
2009/0097689 A1 4/2009 Prest et al.
2009/0105548 A1 4/2009 Bart
2009/0154739 A1 6/2009 Zellner
2009/0191920 A1 7/2009 Regen et al.
2009/0245559 A1 10/2009 Boltyenkov et al.
2009/0261114 A1 10/2009 McGuire et al.
2009/0296968 A1 12/2009 Wu et al.
2010/0033313 A1 2/2010 Keady et al.
2010/0203831 A1 8/2010 Muth
2010/0210212 A1 8/2010 Sato
2010/0320961 A1 12/2010 Castillo et al.
2011/0140844 A1 6/2011 McGuire et al.
2011/0239497 A1 10/2011 McGuire et al.
2011/0286615 A1 11/2011 Olodort et al.
2012/0057740 A1 3/2012 Rosal
2013/0316642 A1 11/2013 Newham
2013/0346168 A1 12/2013 Zhou et al.
2014/0079257 A1 3/2014 Ruwe et al.
2014/0106677 A1 4/2014 Altman
2014/0122116 A1 5/2014 Smythe
2014/0153768 A1 6/2014 Hagen et al.
2014/0163771 A1 6/2014 Demeniuk
2014/0185828 A1 7/2014 Helbling
2014/0219467 A1 8/2014 Kurtz
2014/0222462 A1 8/2014 Shakil et al.
2014/0235169 A1 8/2014 Parkinson et al.
2014/0270227 A1 9/2014 Swanson
2014/0270271 A1 9/2014 Dehe et al.
2014/0335908 A1 11/2014 Krisch et al.
2014/0348367 A1 11/2014 Vavrus et al.
2015/0028996 A1 1/2015 Agrafioti et al.
2015/0035643 A1 2/2015 Kursun
2015/0036835 A1 2/2015 Chen
2015/0110587 A1 4/2015 Hori
2015/0148989 A1 5/2015 Cooper et al.
2015/0245127 A1 8/2015 Shaffer
2015/0373467 A1 12/2015 Gelter
2015/0373474 A1 12/2015 Kraft et al.
2016/0033280 A1 2/2016 Moore et al.
2016/0072558 A1 3/2016 Hirsch et al.
2016/0073189 A1 3/2016 Lindén et al.
2016/0125892 A1 5/2016 Bowen et al.
2016/0353196 A1 12/2016 Baker et al.
2016/0360350 A1 12/2016 Watson et al.
2017/0059152 A1 3/2017 Hirsch et al.
2017/0060262 A1 3/2017 Hviid et al.
2017/0060269 A1 3/2017 Förstner et al.
2017/0061751 A1 3/2017 Loermann et al.
2017/0062913 A1 3/2017 Hirsch et al.
2017/0064426 A1 3/2017 Hviid
2017/0064428 A1 3/2017 Hirsch
2017/0064432 A1 3/2017 Hviid et al.
2017/0064433 A1* 3/2017 Hirsch ..... H04R 1/1041
2017/0064437 A1 3/2017 Hviid et al.
2017/0078780 A1 3/2017 Qian et al.
2017/0078785 A1 3/2017 Qian et al.
2017/0108918 A1 4/2017 Boesen
2017/0109131 A1 4/2017 Boesen
2017/0110124 A1 4/2017 Boesen et al.
2017/0110899 A1 4/2017 Boesen
2017/0111723 A1 4/2017 Boesen
2017/0111725 A1 4/2017 Boesen et al.
2017/0111726 A1 4/2017 Martin et al.
2017/0111740 A1 4/2017 Hviid et al.
2017/0127168 A1 5/2017 Briggs et al.
2017/0142511 A1 5/2017 Dennis
2017/0151447 A1 6/2017 Boesen
2017/0151668 A1 6/2017 Boesen
2017/0151918 A1 6/2017 Boesen
2017/0151930 A1 6/2017 Boesen
2017/0151957 A1 6/2017 Boesen
2017/0151959 A1 6/2017 Boesen
2017/0153114 A1 6/2017 Boesen
2017/0153636 A1 6/2017 Boesen
2017/0154532 A1 6/2017 Boesen
2017/0155985 A1 6/2017 Boesen
2017/0155992 A1 6/2017 Perianu et al.
2017/0155993 A1 6/2017 Boesen
2017/0155997 A1 6/2017 Boesen
2017/0155998 A1 6/2017 Boesen
2017/0156000 A1 6/2017 Boesen
2017/0178631 A1 6/2017 Boesen
2017/0180842 A1 6/2017 Boesen
2017/0180843 A1 6/2017 Perianu et al.
2017/0180897 A1 6/2017 Perianu
2017/0188127 A1 6/2017 Perianu et al.
2017/0188132 A1 6/2017 Hirsch et al.
2017/0193978 A1 7/2017 Goldman
2017/0195829 A1 7/2017 Belverato et al.
2017/0208393 A1 7/2017 Boesen
2017/0214987 A1 7/2017 Boesen
2017/0215016 A1 7/2017 Dohmen et al.
2017/0230752 A1 8/2017 Dohmen et al.
2017/0251933 A1 9/2017 Braun et al.
2017/0257698 A1 9/2017 Boesen et al.
2017/0263236 A1 9/2017 Boesen et al.
2017/0273622 A1 9/2017 Boesen
2018/0276039 A1* 9/2018 Boesen ..... H04L 12/14

FOREIGN PATENT DOCUMENTS

CN 104837094 A 8/2015
EP 1469659 A1 10/2004
EP 1017252 A3 5/2006
EP 2903186 A1 8/2015
GB 2074817 4/1981
GB 2508226 A 5/2014
WO 2008103925 A1 8/2008
WO 2007034371 A3 11/2008
WO 2011001433 A2 1/2011
WO 2012071127 A1 5/2012
WO 2013134956 A1 9/2013
WO 2014046602 A1 3/2014
WO 2014043179 A3 7/2014
WO 2015061633 A2 4/2015
WO 2015110577 A1 7/2015
WO 2015110587 A1 7/2015
WO 2016032990 A1 3/2016

OTHER PUBLICATIONS

Akkermans, "Acoustic Ear Recognition for Person Identification", Automatic Identification Advanced Technologies, 2005 pp. 219-223.

Announcing the $3,333,333 Stretch Goal (Feb. 24, 2014).

Ben Coxworth: "Graphene-based ink could enable low-cost, foldable electronics", "Journal of Physical Chemistry Letters", Northwestern University, (May 22, 2013).

(56) References Cited

OTHER PUBLICATIONS

Blain: "World's first graphene speaker already superior to Sennheiser MX400", htt://www.gizmag.com/graphene-speaker-beats-sennheiser-mx400/31660, (Apr. 15, 2014).
BMW, "BMW introduces BMW Connected-The personalized digital assistant", "http://bmwblog.com/2016/01/05/bmw-introduces-bmw-connected-the-personalized-digital-assistant", (Jan. 5, 2016).
BRAGI Is on Facebook (2014).
BRAG Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).
BRAGI Update—Memories From the First Month of Kickstarter—Update on Progress (Aug. 1, 2014).
BRAGI—Update—Memories From the Second Month of Kickstarter—Update on Progress (Aug. 22, 2014).
BRAGI Update—New People @BRAGI-Prototypes (Jun. 26, 2014).
BRAGI Update—Office Tour, Tour to China, Tour to CES (Dec. 11, 2014).
BRAGI Update—Status on Wireless, Bits and Pieces, Testing-Oh Yeah, Timeline(Apr. 24, 2015).
BRAGI Update—The App Preview, The Charger, The SDK, BRAGI Funding and inese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update-Alpha 5 and Back to China, Backer Day, on Track(May 16, 2015).
BRAGI Update-Beta2 Production and Factory Line(Aug. 20, 2015).
BRAGI Update-Certifications, Production, Ramping Up.
BRAGI Update-Developer Units Shipping and Status(Oct. 5, 2015).
BRAGI Update-Developer Units Started Shipping and Status (Oct. 19, 2015).
BRAGI Update-Developer Units, Investment, Story and Status(Nov. 21, 2015).
BRAGI Update-Getting Close(Aug. 6, 2015).
BRAGI Update-On Track, Design Verification, How It Works and What's Next(Jul. 15, 2015).
BRAGI Update-On Track, on Track and Gems Overview.
BRAGI Update-Status on Wireless, Supply, Timeline and Open House@BRAGI(Apr. 1, 2015).
BRAGI Update-Unpacking Video, Reviews on Audio Perform and Boy Are We Getting Close(Sep. 10, 2015).
Healthcare Risk Management Review, "Nuance updates computer-assisted physician documentation solution" (Oct. 20, 2016).
Hoffman, "How to Use Android Beam to Wirelessly Transfer Content Between Devices", (Feb. 22, 2013).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces a Health + Mobility Concept for Wellness in Mobility", Fountain Valley, Californa (2017).
International Search Report & Written Opinion, PCT/EP2016/070231 (dated Nov. 18, 2016).
Last Push Before the Kickstarter Campaign Ends on Monday 4pm CET (Mar. 28, 2014).
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Nuance, "ING Netherlands Launches Voice Biometrics Payment System in the Mobile Banking App Powered by Nuance", "https://www.nuance.com/about-us/newsroom/press-releases/ing-netherlands-launches-nuance-voice-biometrics.html", 4 pages (Jul. 28, 2015).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for the Dash (Feb. 12, 2014).
Stretchgoal—Windows Phone Support (Feb. 17, 2014).
The Dash + The Charging Case & The BRAGI News (Feb. 21, 2014).
The Dash—A Word From Our Software, Mechanical and Acoustics Team + An Update (Mar. 11, 2014).
Update From BRAGI—$3,000,000—Yipee (Mar. 22, 2014).
Wertzner et al., "Analysis of fundamental frequency, jitter, shimmer and vocal intensity in children with phonological disorders", V. 71, n.5, 582-588, Sep./Oct. 2005; Brazilian Journal of Othrhinolaryngology.
Nikipedia, "Gamebook", https://en.wikipedia.org/wiki/Gamebook, Sep. 3, 2017, 5 pages.
Wikipedia, "Kinect", "https://en.wikipedia.org/wiki/Kinect", 18 pages, (Sep. 9, 2017).

* cited by examiner

DUAL EARPIECES FOR SAME EAR

PRIORITY STATEMENT

This application claims priority to U.S. Provisional Patent Application 62/414,973, filed on Oct. 31, 2016, and entitled Dual earpieces for same ear, hereby incorporated by reference in its entirety.

FIELD OF THE INVENTION

The present invention relates to wearable devices. More particularly, but not exclusively, the present invention relates to wireless earpieces.

BACKGROUND

Wireless earpieces are a new class of consumer electronic device with a great deal of commercial potential. However, as earpieces tend to be used quite extensively when worn, battery life remains a concern. One way to combat this is to have a pair of left and right earpieces, with one earpiece charging while the other earpiece is either being worn or used. Moreover, one earpiece may be configured as the master unit (e.g., a left earpiece) and another as the slave unit (e.g., a right earpiece). As such, it is beneficial in this and other instances to have a similarly configured earpiece for the same ear.

SUMMARY

Therefore, it is a primary object, feature, or advantage of the present invention to improve over the state of the art.

It is an object, feature, or advantage of the present invention to provide at least a pair of similarly conformed earpieces for the same ear and a smart case configured to dock the pair of similarly conformed earpieces.

It is another object, feature, or advantage of the present invention to provide at least a pair of earpieces conformed for the same ear where each earpiece is also configured as a master control unit.

It is a further object, feature, or advantage of the present invention to provide an additional wireless earpiece in order to ensure a user always has a wireless earpiece with sufficient battery life.

It is a still further object, feature, or advantage of the present invention to synchronize the data between a worn wireless earpiece and a smart case in order to facilitate data transfer.

According to one aspect, a system having a set of wireless earpieces is disclosed. The system includes a set of wireless earpieces anatomically conformed for wearing in the same ear. Each wireless earpiece can include an earpiece housing, a speaker disposed within the earpiece housing, a memory device disposed within the earpiece housing, a transceiver disposed within each earpiece housing, and a processor disposed within each earpiece housing and operatively connected to the speaker and the transceiver. In at least one other aspect, the system includes a case having a case housing with a set of receptacles. The set of receptacles substantially define contours having the anatomical conformity of the set of wireless earpieces. The case can include an electromechanical connector disposed within each receptacle. Each wireless earpiece of the set of wireless earpieces is coupled to each electromechanical connector. An energy source can be disposed within the case housing.

According to another aspect, a pair of wireless earpieces is disclosed. The wireless earpieces can include an earpiece housing having an anatomically conformity for the same ear and a speaker disposed within the earpiece housing. A memory device, transceiver, and processor can be disposed within the earpiece housing. In at least one aspect, each earpiece of the set of wireless earpieces includes a master control device configured to receive a user-input and process the user-input with the processor to control the other earpiece.

According to a further aspect, a method for communicating between wireless earpieces is disclosed. The method includes providing a pair of wireless earpieces with an earpiece housing having an anatomically conformity for the same ear, a speaker, memory, transceiver, and processor disposed within the earpiece housing. A signal can be transmitted between the pair of wireless earpieces for performing a first operation on a first earpiece of the pair to control a second operation on a second earpiece of the pair. In at least a further aspect, the method can include transmitting a signal between the second earpiece worn by a user and the first earpiece docked within a case and transmitting a signal between the first earpiece worn by a first user and the second earpiece worn by a second user.

One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by an object, feature, or advantage stated herein.

Figure 1:
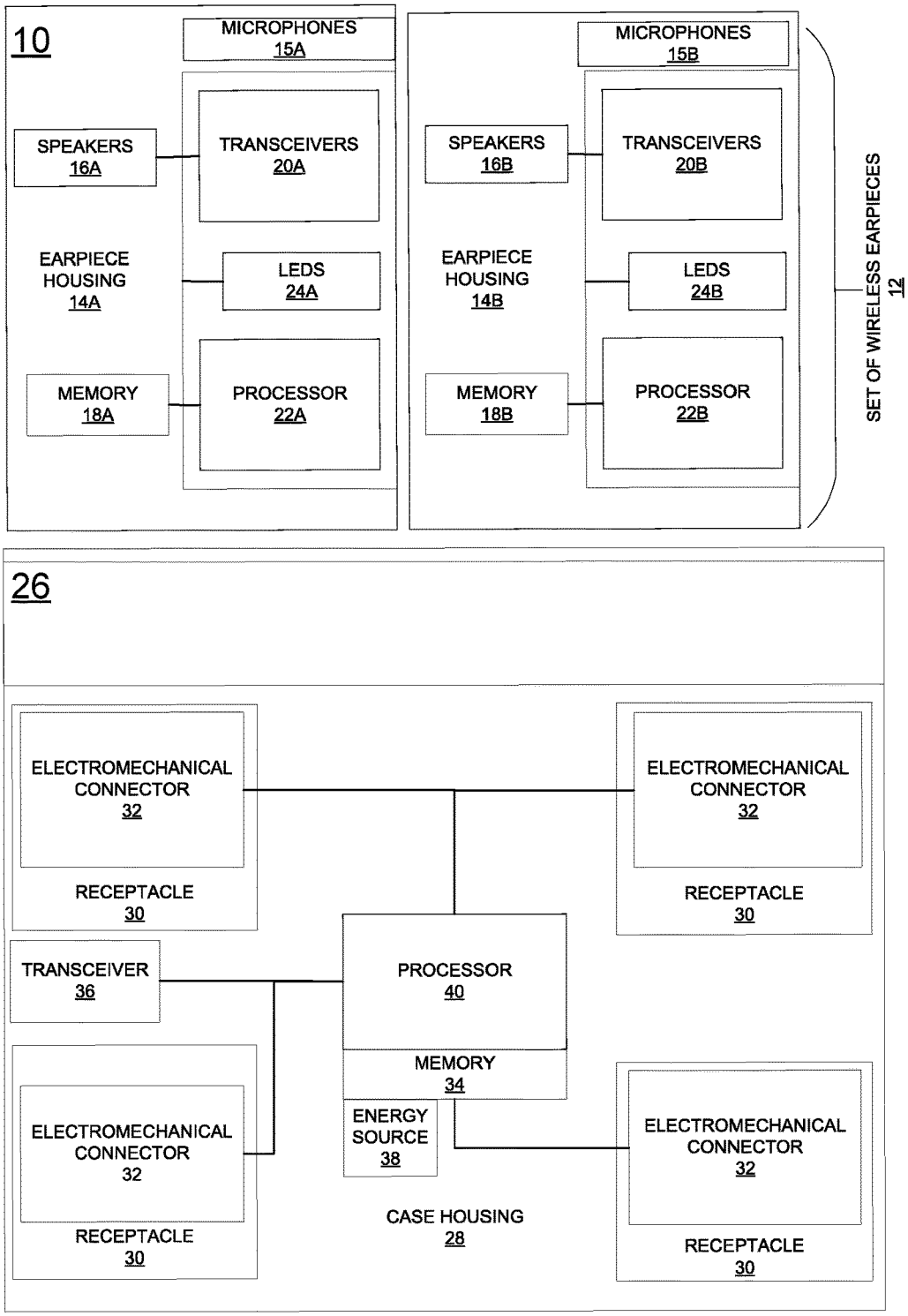
FIG. 1 illustrates a block diagram of a system.

Some of the figures include graphical and ornamental elements. It is to be understood that the present invention contemplates all permutations and combinations of the various graphical elements set forth in the figures thereof.

DETAILED DESCRIPTION

The illustrative embodiments provide a system, method, smart case, and wireless earpieces for interchanging wireless earpieces for communication. Traditionally, a left and right ear conformed wireless earpiece may represent a pair of wireless earpieces. However, a pair of wireless earpieces may be (anatomically) conformed to wear in the same ear. The features and functionality of the pair of wireless earpieces may be similar or identical. For example, both earpieces may be configured as a master control unit. Alternatively, both earpieces may be configured as a slave unit. Yet, in another configuration, similarly (anatomically) conformed earpieces may be configured so one earpiece acts as a master control unit and the other earpiece a slave unit. The features and advantages derived from the adaptability of the configuration of a pair of similarly or identically conforming wireless earpieces are many as set forth by way of example herein.

To streamline communications, conserve battery, simplify manufacturing processes, expand configurability options, and provide a generally more robust system, electronic devices traditionally operating in tandem as pairs are configured so one of the devices operates as a control unit (i.e., master unit) and the other device a passive/semi-passive unit (i.e., slave unit). In the context of the present invention, wireless earpieces anatomically conformed for the same ear may be configured whereby the pair of earpieces each are configured and perform the same functions as a control unit. The different type of earpiece configurations, controls and functions are set forth below. There are several advantages for having at least a pair of earpieces (anatomically) conformed for the same ear and electronically configured in a similar manner. It is particularly beneficial to have a pair of earpieces conformed for the same ear where both earpieces are configured as control units.

The smart case may store one or more sets of wireless earpieces for personal, business, commercial, or organizational usage. In one embodiment, a smart case may store, charge, and synchronize data for a number of wireless earpieces. As needed by a user wearing or otherwise utilizing the wireless earpieces, a wireless earpiece may be swapped out for another wireless earpiece (e.g., a first left wireless earpiece with a dead battery may be placed in the smart case and a second left wireless earpiece may be removed from the smart case for utilization). The wireless earpiece removed from the smart case may be securely connected or linked to another wireless earpiece already being utilized (e.g., the second left wireless earpiece may be securely linked to a right wireless earpiece being worn by the user).

In one embodiment, a system includes a set of wireless earpieces. Each of the wireless earpieces include a left earpiece and a right earpiece. Each wireless earpiece further includes an earpiece housing, a speaker operatively connected to each earpiece housing, a memory device disposed within the earpiece housing, a transceiver disposed within each earpiece housing, a processor disposed within each earpiece housing and operatively connected to the speaker and the transceiver, and a smart case including a case housing including a set of receptacles. The set of receptacles substantially define contours of the set of wireless earpieces, an electromechanical connector disposed within each receptacle for coupling with the set of wireless earpieces, a memory device disposed within the case housing, a transceiver disposed within the case housing, an energy source disposed within the case housing, and a processor disposed within the case housing and operatively connected to the memory device, the transceiver, and the energy source. A connection is initiated between the smart case and a detached wireless earpiece from the set of wireless earpieces in response to a detachment of the wireless earpiece of the set of wireless earpieces from an electromechanical connector of the smart case.

In another embodiment, a system and method includes a set of wireless earpieces including all left or all right wireless earpieces and a smart case configured to hold each wireless earpiece of the set of wireless earpieces. A connection is initiated between the smart case and a wireless earpiece detached from the smart case in response to the detachment of the wireless earpiece.

One or more of the following features may be included. The detached wireless earpiece from the smart case may establish the connection to the smart case. The connection may be established in response to a voice command. The connection may be terminated in response to attachment of the detached wireless earpiece to an electromechanical connector. The connection may encode data. The energy source of the smart case may deliver energy to the set of wireless earpieces via the electromechanical connectors. Each wireless earpiece may further comprise an LED operatively connected to each earpiece housing, wherein each LED displays information derived from the data. The speaker of the detached wireless earpiece may communicate information derived from the data. The detached wireless earpiece may establish a second connection to a wireless earpiece from the set of wireless earpieces in response to an additional voice command. The detached wireless earpiece may establish a third connection to a network. The network may be in operative communication with a mobile phone or a third party database.

In one embodiment, the wireless earpieces are securely linked in response to a signal or command from the smart case. In another embodiment, wireless earpieces may utilize a signal, connection, or link to search for each other. Authorized and validated wireless earpieces may be securely connected for performing communications and other functionality. For example, a handshake, device identifier, user preferences, database information, user authorization (e.g., voice approval, tactile input, etc.) may be utilized to initiate or authorize the connection between a newly connected set of wireless earpieces (e.g., left and right wireless earpieces authorized for secure communications).

The wireless earpieces may include any number of sensors for reading user biometrics, such as pulse rate, blood pressure, blood oxygenation, temperature, orientation, calories expended, blood or sweat chemical content, voice and audio output, impact levels, and orientation (e.g., body, head, etc.). The sensors may also determine the user's location, position, heart rate, voice stress levels, and so forth. The sensors may also receive user input and convert the user input into commands or selections made across the personal devices of the personal area network. For example, the user input detected by the wireless earpieces may include voice commands, head motions, finger taps, finger swipes, motions or gestures, or other user inputs sensed by the wireless earpieces. The user input may be received, parsed, and converted into commands, queries, and requests associated with the input that may be utilized internally by the wireless earpieces or sent to one or more external devices, such as a tablet computer, smart phone, laptop, or so forth. The wireless earpieces may perform sensor measurements for the user to read any number of user biometrics. The user biometrics may be analyzed including measuring deviations or changes of the sensor measurements over time, identifying trends of the sensor measurements, and comparing the sensor measurements to control data for the user.

The wireless earpieces may also measure environmental conditions, such as temperature, location, barometric pressure, humidity, radiation, wind speed, chemical content of the air, noise levels, and other applicable environmental data. The wireless earpieces may also communicate with external devices to receive additional sensor measurements. The wireless earpieces may communicate with external devices to receive available information, which may include information received through one or more networks, such as the Internet.

The illustrative embodiments allow a user to quickly and efficiently swap out wireless earpieces to charge batteries, perform software updates, synchronize data, select a different size, perform cleaning, or any number of other reasons. The user may be assured that communications between the wireless earpieces are secure and authorized based on the processes of the described embodiments.

FIG. 1 illustrates a block diagram of a system 10 including a set of wireless earpieces 12 and a smart case 26. The set of wireless earpieces 12 may include either a set of left earpieces or a set of right earpieces. Each wireless earpiece may further include an earpiece housing 14A, 14B, a speaker 16A, 16B operatively connected to each earpiece housing 14A, 14B, a memory 18A, 18B operatively connected to each earpiece housing 14A, 14B, a transceiver 20A, 20B disposed within each earpiece housing 14A, 14B, and a processor 22A, 22B operatively connected to each component within their respective wireless earpieces and earpiece housings 14A, 14B. Microphones 15A, 15B and light emitting diodes (LEDs) 24A, 24B may also be operatively connected to each earpiece housing 14A, 14B.

Earpiece housings 14A, 14B are a framework shaped to fit substantially within the ear of the user. The earpiece housings 14A, 14B may include a frame or other support structure that at least partially encloses and houses the electronic components of the wireless earpieces 12. The earpiece housings 14A, 14B may be composed of plastic, metal, polymers, non-metals, or any material or combination of materials having substantial deformation resistance in order to facilitate energy transfer if a sudden force is applied to the wireless earpieces 12. For example, if one of the wireless earpieces 12 is dropped by a user when inserting or removing the wireless earpiece from the smart case 26, the earpiece housings 14A, 14B may transfer the energy received from the surface impact throughout the entire wireless earpiece.

In addition, the earpiece housings 14A, 14B may be capable of a degree of flexibility in order to facilitate energy absorbance if one or more forces is applied to the earpiece. For example, if an object is dropped on one of the wireless earpieces 12, the earpiece housings 14A, 14B may bend in order to absorb the energy from the impact. The flexibility of the earpiece housings 14A, 14B should not, however, be flexible to the point where one or more components of the earpiece may become dislodged or otherwise rendered non-functional if one or more forces is applied to the earpiece. The earpiece housings 14A, 14B may also waterproof all or portions of the wireless earpieces 12 with the other exposed components also being waterproof or water resistant. The wireless earpieces 12 may also include one or more sleeves that fit over a portion of the earpiece housings 14A, 14B and within ears of the user. The sleeves may come in any number of sizes and shapes to fit the size and shape of the ears of the user ensuring good audio transmission, sensor readings, tactile feedback, and so forth.

Microphones 15A, 15B may be operatively connected or mounted within the earpiece housings 14A, 14B and may be configured to receive voice commands and other audio input from the user. The microphones 15A, 15B may include air microphones located on an exterior portion of the wireless earpieces 12 when worn by the user and an ear-bone or bone conduction microphone that may be positioned within the user's ear when worn by the user to utilize vibrations as well as sound to receive audio input (e.g., sound communicated through the skull and bones of the user when speaking). The microphones 15A, 15B may include a single microphone or a number of different microphones. The voice and audio input received from the user may be processed by the processor 221 for any number of software systems, such as an operating system, program applications, or so forth. For example, if the user wants to establish a connection to the smart case 26 or wants to adjust one or more parameters of an algorithm executed by processors 22A, 22B, the user may issue a voice command to bring up a menu communicated by speakers 16A, 16B, which may include one or more selections that the user may choose from using additional voice commands until a connection is established or one or more parameters of one or more programs is modified. Programs unrelated to connecting to the smart case 26 may also be initiated, terminated, downloaded, uploaded, or modified via one or more voice commands by the user.

Speakers 16A, 16B may be operatively connected to or mounted within the earpiece housings 14A, 14B and may be configured to communicate one or more sounds to a user of the wireless earpieces 12. Although not shown, the one or more speakers 16A, 16B of the wireless earpieces 12 may include a number of speaker components (e.g., signal generators, amplifiers, drivers, and other circuitry) configured to generate sounds waves at distinct frequency ranges (e.g., bass, woofer, tweeter, midrange, etc.) or to vibrate at specified frequencies to be perceived by the user as sound waves. The speakers may also generate sound waves to provide three-dimensional stereo sound to the user.

The sounds communicated by the speakers 16A, 16B may originate from memories 18A, 18B disposed within the earpiece itself, one or more signals received from wireless devices, such as the smart case 26, a mobile phone, a tablet, a communications tower, or other electronic devices.

Sounds or audio communicated from any of the aforementioned sources may be communicated utilizing any number of standards, protocols, or processes (e.g., real-time streams, encoded packets, files, encrypted data, etc.) For example, a user may be listening to a song stored in a memory of the wireless earpiece (or a radio station playing songs encoded in signals transmitted by a radio tower) when the speakers 16A, 16B may communicate a weather report originating from a signal transmitted by a mobile phone associated with the wireless earpieces. In another example, the wireless earpieces 12 may be playing a radio station received from a linked tablet, when the speakers 16A, 16B may communicate a signal transmitted by the smart case 26 indicating that the smart case 26 is running low on power or that a wireless earpiece stored in the smart case 26 is fully recharged. The speakers 16A, 16B may also communicate warnings concerning the battery life and status of the wireless earpieces 12, if, and when, necessary.

Memories 18A, 18B may be operatively connected to or mounted within the earpiece housings 14A, 14B. The memories 18A, 18B are hardware elements, devices, or recording media configured to store data for subsequent retrieval or access at a later time. The memories 18A, 18B may be or include static and/or dynamic memory. The memories 18A, 18B may include one or more of a hard disk, random access memory, cache, removable media drive, mass storage, or configuration suitable as storage for data, instructions, and information. In one embodiment, the memories 18A, 18B and the processors 22A, 22B may be integrated. The memories 18A, 18B may use any type of volatile or non-volatile storage techniques and mediums. The memories 18A, 18B may store information related to the status of a user, wireless earpieces 12, and other peripherals, such as a wireless device, smart case 26 for the wireless earpieces 12, smart watch, and so forth. In one embodiment, the memories 12 may display instructions or programs for controlling a user interface 7 including one or more LEDs 24A, 24B or other light emitting components, speakers 16A, 16B, tactile generators (e.g., vibrator), and so forth. The memories 18A, 18B may also store the user input information associated with each command. The memories 18A, 18B may store user preferences including parameters, settings, factors, user information, and so forth that may be utilized to implement automatic or manual processes as are herein described.

In one example, the memories 18A, 18B may store data, operating systems, instructions, and/or applications related to the functioning of the wireless earpieces 12. For example, memories 18A, 18B may store information encoded in one or more signals received from the smart case 26 concerning the battery life or functionality of one or more wireless earpieces 12, the functionality of the smart case 26, or product information related to the operation of the wireless earpieces 12 from a manufacturer, licensor, or distributor of the wireless earpieces 12 or one or more components of the wireless earpieces 12. In addition, the memories 18A, 18B may store information encoded in signals received from electronic devices other than the smart case 26. For example, memories 18A, 18B may store media downloaded from a mobile phone, a tablet, a laptop, a desktop, a communications tower, a Wi-Fi hotspot, or another electronic device capable of transmitting signals. Other information desired by the user or a third party may also be stored on memories 18A, 18B.

Transceivers 20A, 20B may be mounted within earpiece housings 14A, 14B. The transceivers 20A, 20B are components including both a transmitter and receiver which may be combined and share common circuitry, chip, on a single housing. The transceivers 20A, 20B may be configured to transmit information between the wireless earpieces 12 or the smart case 26. Transceivers 20A or 20B may be near field magnetic imaging (NFMI) transceivers, Bluetooth transceivers, WiMax transceivers, Wi-Fi transceivers, or other transceivers meeting one or more IEEE standards. Transceivers 20A, 20B may also be capable of receiving signals from electronic devices located at substantial distances from the user or earpiece. For example, signals received from a mobile phone or a radio tower (e.g., 3G, 4G, 5G, PCS, LTE, etc.) encoding media or information related to the wireless earpieces 12 or smart case 26 by transceiver 20A may be retransmitted by transceiver 20A to transceiver 20B, which may further communicate the signal to processor 22B, memory 18B, or even the smart case 26. Transceivers 20A, 20B may also receive signals from the smart case 26 related to the operation of either the smart case 26 or the wireless earpieces 12 or media or information stored in a memory operatively connected or accessible to the smart case 26. More than one type of transceiver may be located in an earpiece. For example, the transceivers 20A, 20B may be a hybrid or multi-mode transceiver that supports a number of different communications. For example, the transceivers 20A, 20B may communicate with a smart phone utilizing Bluetooth communications and with each other (or other wireless earpieces) utilizing NFMI.

Processors 22A, 22B may be disposed, mounted, or integrated within the earpiece housings 14A, 14B and operatively connected to the components of the respective wireless earpieces 12 including, but not limited to, speakers 16A, 16B, memories 18A, 18B and transceivers 20A, 20B. In one embodiment, the processors 22A, 22B include circuitry or logic enabled to control execution of a set of instructions. The processors 22A, 22B may be one or more microprocessors, digital signal processors, application-specific integrated circuits (ASIC), central processing units, or other devices suitable for controlling an electronic device including one or more hardware and software elements, executing software, instructions, programs, and applications, converting and processing signals and information, and performing other related tasks.

The processors 22A, 22B may be configured to process information received from the various components. The processors 22A, 22B may execute any number of operating systems, kernels, applications, or instructions. For example, processors 22A, 22B may execute a program stored in memories 18A, 18B related to energy management in order to determine the appropriate amount of energy to provide to the various components of the wireless earpieces 12. For example, the determination may use information encoded in a signal received from transceivers 20A, 20B in order to determine the appropriate amount of energy to provide each wireless earpiece component. In addition, the processors 22A, 22B may instruct the speakers 16A, 16B to communicate the amount of energy each of the wireless earpieces 12 has available either intermittently or in response to a command from the user or a third party, user preferences, detected events, or so forth.

LEDs 24A, 24B may be operatively connected to or mounted within the earpiece housings 14A, 14B. The LEDs 24A, 24B RA are semiconductor based light sources. The LEDs 24A, 24B may also include displays, touch sensors, or other interface components. The LEDs 24A, 24B may be configured to provide information concerning the wireless earpieces 12. For example, processors 22A, 22B may communicate a signal encoding information related to the current time, the battery life of the earpiece, the status of another operation of the earpiece, or another earpiece function, wherein the signal is decoded and displayed by the LEDs. For example, processors 22A, 22B may communicate a signal encoding the status of the energy level of the wireless earpieces 12. For example, the energy level may be decoded by LEDs 24A, 24B as a blinking light, a green light may represent a substantial level of battery life, a yellow light may represent an intermediate level of battery life, a red light may represent a limited amount of battery life, and a blinking red light may represent a critical level of battery life requiring immediate recharging. In addition, the battery life may be represented by the LEDs as a percentage of battery life remaining or may be represented by an energy bar having one or more LEDs. The number of illuminated LEDs represents the amount of battery life remaining in the wireless earpieces 12, respectively. The LEDs 24A, 24B may be located in any area on the wireless earpieces 12 suitable for viewing by the user or a third party and may include a single diode which may be provided in combination with a light guide. In addition, the LEDs 24A, 24B need not have a minimum luminescence.

The smart case 26 is a storage for the wireless earpieces 12. The smart case 26 may be utilized to charge, synchronize data, update software, and protect the wireless earpieces 12. In one example, the smart case 26 may store 2-6 wireless earpieces 12. In one embodiment, the smart case 26 may include a case housing 28, a set of receptacles 30 disposed within the case housing 28 and configured to define the contours of the wireless earpieces 12, one or more electromechanical connectors 32 disposed within each receptacle 30, a memory device 34 operatively connected to the case housing 28, a transceiver 36 operatively connected to the case housing 28, an energy source 38 disposed within the case housing 28 and operatively connected to each component of the smart case 26, and a processor 40 disposed within the case housing 28 and operatively connected to each component of the smart case 26. The internal components may be located at any suitable location within the smart case 26.

The smart case 26 may have one or more of the wireless earpieces 12 removably connected to one or more electromechanical connectors 32. The user or a third party may remove one or more of the wireless earpieces 12 if the user wishes to use one of the wireless earpieces 12 or a wireless earpiece the user or third party is using needs to be recharged in one of the receptacles 30. If the user or third party remove one of the wireless earpieces 12 from the smart case 26, the smart case 26 may initiate a connection with the detached wireless earpiece by executing a program stored on the memory device 34 via the processor 40 to transmit a signal via the transceiver 36 to the detached wireless earpiece, which may establish the connection in response to the signal from the smart case 26. The signal may encode instructions for synchronizing data stored or received by the wireless earpiece with data stored or received by the smart case 26 or other earpieces of the earpiece set 12 attached to one of the electromechanical connectors 32 of the smart case 26.

Alternatively, if the user or third party removes one of the wireless 12 from an electromechanical connector 32, that wireless earpiece may initiate a connection with the other wireless earpieces 12 connected to the electromechanical connectors 32. The connection may be initiated using a program stored in a memory device of the detached wireless earpiece executed by a processor in the detached wireless earpiece to transmit a signal via a transceiver of the detached wireless earpiece to each wireless earpiece attached to an electromechanical connector 32. The wireless earpieces 12 that receive the signal may communicate a response signal to the detached wireless earpiece to establish the connection. In addition, the one or more of the response signals may establish data synchronicity with the detached wireless earpiece.

The case housing 28 may be composed of plastic, metal, polymers, nonmetal materials, or any material or combination of materials having substantial deformation resistance in order to facilitate energy transfer if a sudden force is applied to the smart case 26. For example, if the smart case 26 is dropped by a user, the case housing 28 may transfer the energy received from the surface impact throughout the entire smart case 26. In addition, the case housing 28 may be capable of a degree of flexibility in order to facilitate energy absorbance if one or more forces is applied to the smart case 26. For example, if an object is dropped on the smart case 26, the case housing 28 may bend in order to absorb the energy from the impact. The flexibility of the case housing 28 is not, however, flexible to the point where one or more components of the smart case 26 may become dislodged or otherwise rendered non-functional.

Receptacle set 30 may be disposed within the case housing 28 and may substantially define the contours of a wireless earpiece. Only a portion of a wireless earpiece may be substantially defined, and the space between an attached wireless earpiece and the inner surface of each receptacle may be anywhere from very limited to substantial depending on the size of a wireless earpiece relative to the smart case 26.

Electromechanical connectors 32 may be disposed within each receptacle of receptacle set 30 and may be configured to couple to a wireless earpiece. The coupling may be by way of magnetic coupling and/or mechanical coupling. For example, each electromechanical connector 32 may be magnetized in order to couple with a metallic element of a wireless earpiece, or each electromechanical connector may have a latch in which to hook the wireless earpiece. It may be appreciated that more than one way of mechanically latching a wireless earpiece to an electromechanical connector may be employed. In addition, each electromechanical connector may be configured to facilitate energy transfer from the energy source 38 to each wireless earpiece or facilitate data transfer between the memory device 34, the transceiver 36 or the processor 40 and an earpiece coupled to the electromechanical connector.

A memory 34 may be operatively connected to or mounted within the case housing 28 and may store data and/or applications related to the functioning of the smart case 26. For example, the memory 34 may store one or more software applications, instructions, or data related to the battery life of the smart case 26, the smart case 26, a wireless earpiece within the earpiece set 12, or product information related to the components or operation of the smart case 26 or the wireless earpieces 12 from a user, manufacturer, licensor, service provider, or distributor. In addition, the memory 34 may store information encoded in signals received from wireless earpieces 12 or other electronic devices. For example, the memory 34 may store media downloaded from a mobile phone, a tablet, a laptop, a desktop, a communications tower, a Wi-Fi hotspot, or another electronic device capable of transmitting signals. In addition, the memory 34 may store information encoded in signals from a detached wireless earpiece related to the wireless earpiece's battery life or information stored in memories 18A or 18B if data synchronization has been established. Other information desired by the user or a third party may also be stored on device 34.

Transceiver 36 may be disposed within the case housing 28 and may be configured to transmit information to or receive information from the wireless earpieces 12. For example, the processor 40 of the smart case 26 may instruct the transceiver 36 to transmit a signal encoding information related to data synchronization to a detached wireless earpiece in order to better facilitate data synchronization. A detached wireless earpiece may respond by, for example, modifying its sample or processing rate, and transmitting the new sample or processing rate to the transceiver 36. In one embodiment, the transceiver 36 may be a near field magnetic imaging (NFMI) transceiver, a Bluetooth transceiver, a WiMax transceiver, a Wi-Fi transceiver, or another transceiver meeting one or more IEEE standards. The transceiver 36 may also be capable of receiving signals from electronic devices located at substantial distances from the user or wireless earpieces 12. For example, signals received from a mobile phone or a radio tower encoding media or information related to the wireless earpieces 12 or smart case 26 by transceiver 36 may be retransmitted by transceiver 36 to transceivers 20A or 20B. Transceiver 36 may also receive signals related to media or information that the user or a third party desires to listen to. More than one type of transceiver may be located in the wireless earpieces 12.

Energy source 38 may be disposed within the case housing 28 and operatively connected to each component within the smart case 26. The energy source 38 may represent a rechargeable battery, solar cell, piezo electric generator, thermal generator, ultra-capacitor, fuel cell, or other power storage or generation device. The energy source 38 should provide enough power to both operate the smart case 26 and recharge the wireless earpieces 12 coupled with the electromechanical connector 32. The energy source 38 may be of any type suitable for powering the smart case 26. However, the energy source 38 need not be present in the smart case 26. Alternative battery-less power sources, such as sensors configured to receive energy from radio waves (all of which are operatively connected to the smart case 26) may be used to power the smart case 26 in lieu of the energy source 38.

Processor 40 may be disposed within the case housing 28 and operatively connected to each electromechanical connector 32, the memory device 34, the transceiver 36, and the energy source 38 and may be configured to process information encoded in signals received from the transceiver 36, process information stored in memory device 34, execute one or more programs stored in memory device 34 or within the processor 40 itself, or communicate signals encoding information to any wireless earpieces connected to the electromechanical connector 32. For example, the processor 40 may execute a program stored in the memory device 34 related to the energy management of the smart case 26 and the earpiece set 12 using information concerning earpiece battery life encoded in signals received by the transceiver 36 to determine how much energy is available to provide to the various components of the smart case 26 after recharging one or more detached wireless earpieces 12. In addition, the processor 40 may communicate data and/or instructions from the memory 34 or instructions encoded in signals received by the transceiver 36 via the electromechanical connectors 32 to one or more the wireless earpieces 12 currently coupled with the electromechanical connector 32.

Figure 2:
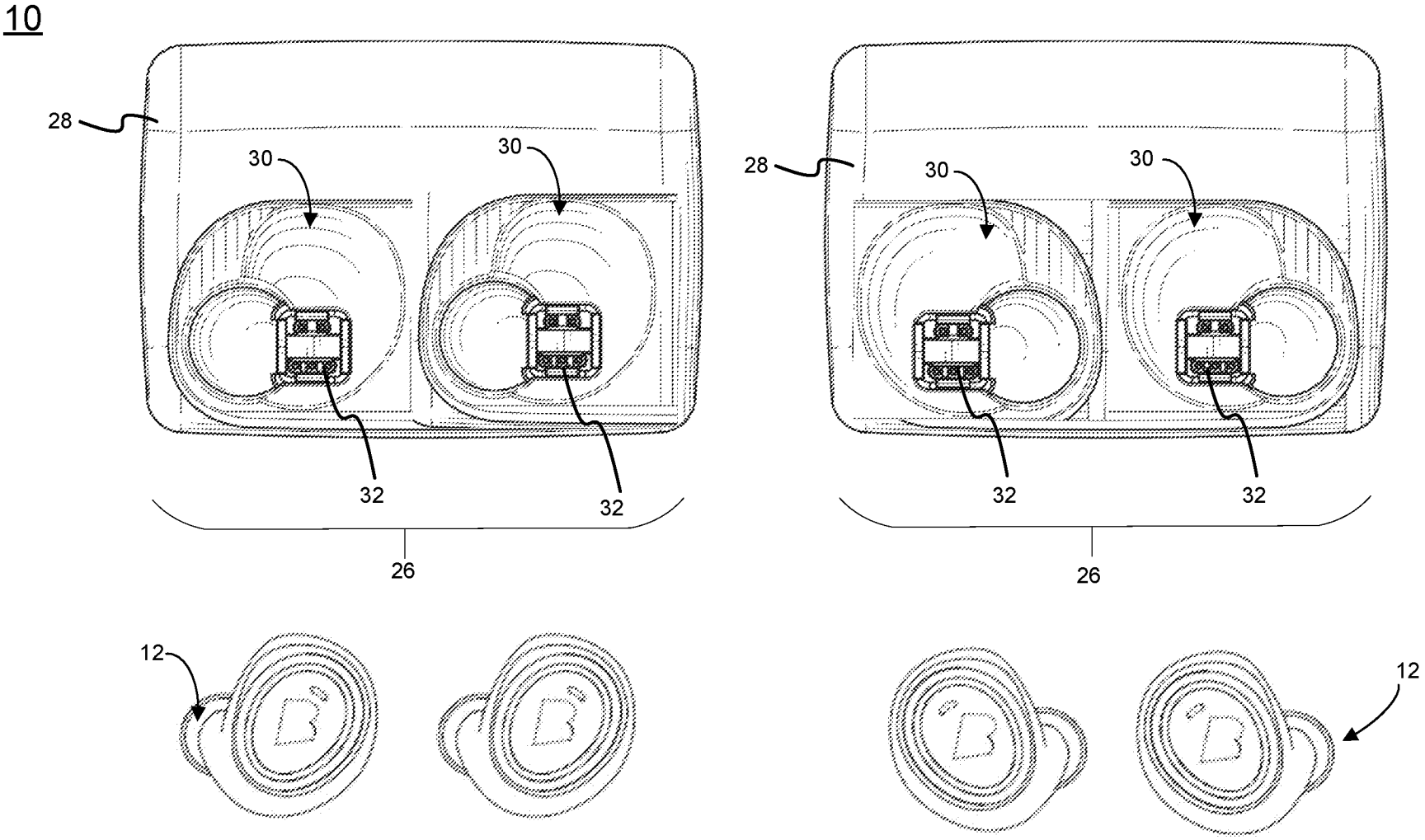
FIG. 2 illustrates one embodiment of a system.

FIG. 2 illustrates one embodiment of a system 10 including set of wireless earpieces 12 and the smart case 26. The set of wireless earpieces 12 are either a pair of left earpieces or a pair of right earpieces and are operatively connectable to electromechanical connectors 32 found in each receptacle 30 of the smart case 26. More than one pair of left or right earpieces may be used if desired. Upon being removed from a receptacle, the smart case 26 initiates a connection to the detached wireless earpiece of the wireless earpieces 12 via a signal transmitted by the transceiver 36. The detached wireless earpieces 12 may establish the connection automatically, in response to an algorithm stored in the memories (18A or 18B), or in response to a user command. For example, if the detached wireless earpiece does not establish the connection automatically, the detached wireless earpiece may establish the connection in response to a specific set of instructions delineating in what circumstances the wireless earpiece is to establish a connection (such as the battery life remaining in the wireless earpiece or how much space is available in the memories (18A or 18B)) or may establish a connection in response to a voice command provided by the user.

The signal received from the transceiver 36 may also include instructions for synchronizing data between one or more detached wireless earpieces and the smart case 26. For example, media or information received or stored by the smart case 26 may be directly transmitted to a detached wireless earpiece and vice-versa via the connection. In addition, the processor 40 of the smart case 26 may transmit data received from the detached wireless earpiece to any wireless earpieces currently coupled with the electromagnetic connector 32. The connection may be terminated by reconnecting the detached wireless earpiece to the smart case 26, via a voice command by the user or a third party, or via an algorithm stored in either the memory of a detached wireless earpiece or the memory 34 of the smart case 26.

Figure 3:
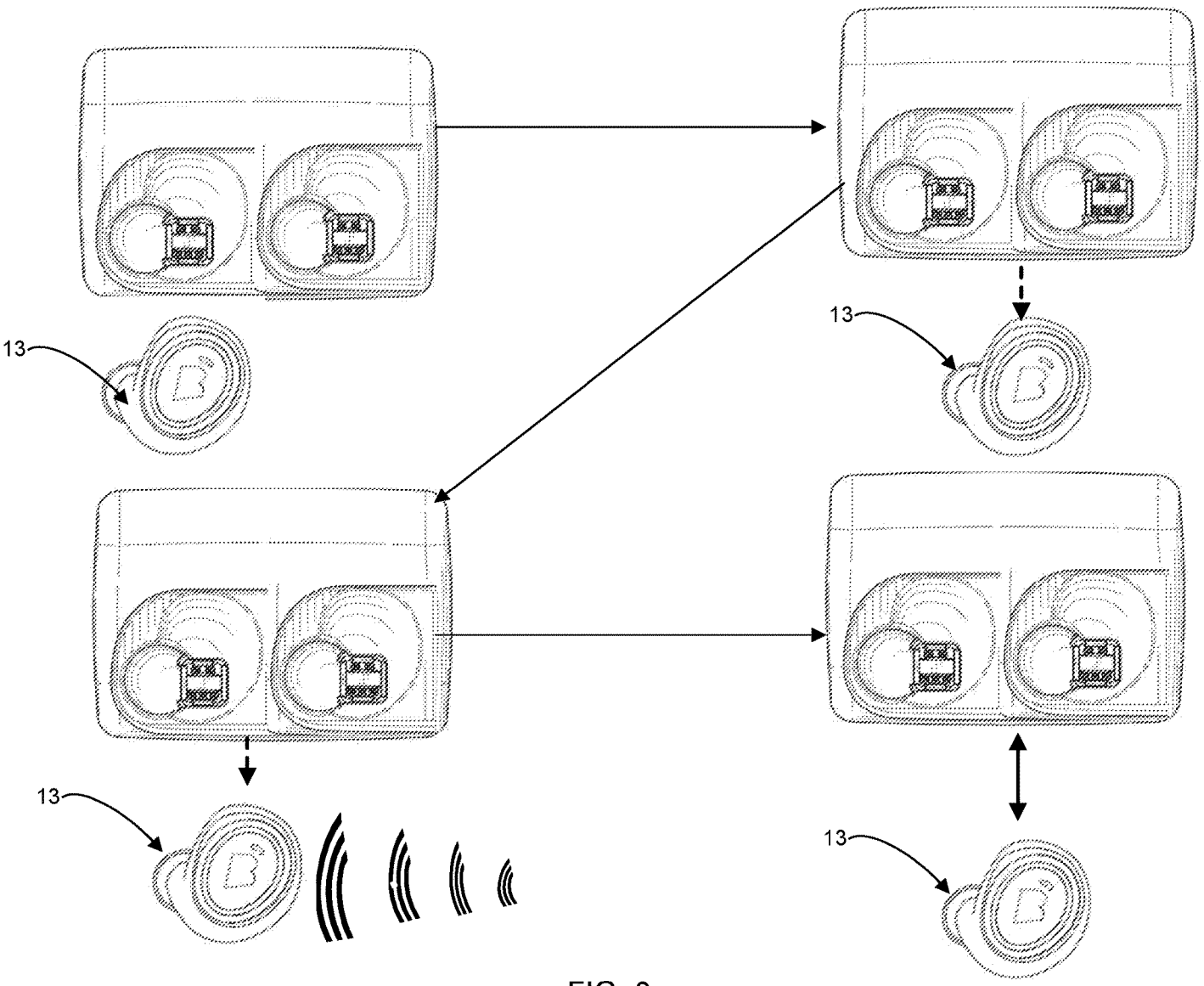
FIG. 3 illustrates how a connection is established between a detached wireless earpiece and a smart case.

FIG. 3 illustrates how a connection may be established between the smart case 26 and at least one of the wireless earpieces 12 after a wireless earpiece is detached from an electromechanical connector of the smart case 26. First, a wireless earpiece is detached from the smart case 26. The detachment may be performed by the eventual user or wearer of the earpiece or another third party. Immediately after detachment of a wireless earpiece 13, the smart case 26 initiates a connection to the detached wireless earpiece 13. The connection may comprise data stored in the memory of the smart case or received from another electronic device. After initializing the connection, the wireless earpiece 13 may automatically establish the connection or a user may provide a voice command or other action to establish the connection. The voice command may be a simple word, a combination of words, a sound, or a combination of sounds, and more than one voice command may be used to establish the connection. The connection may be terminated by an additional voice command or by attachment of the detached earpiece to the smart case.

Figure 4:
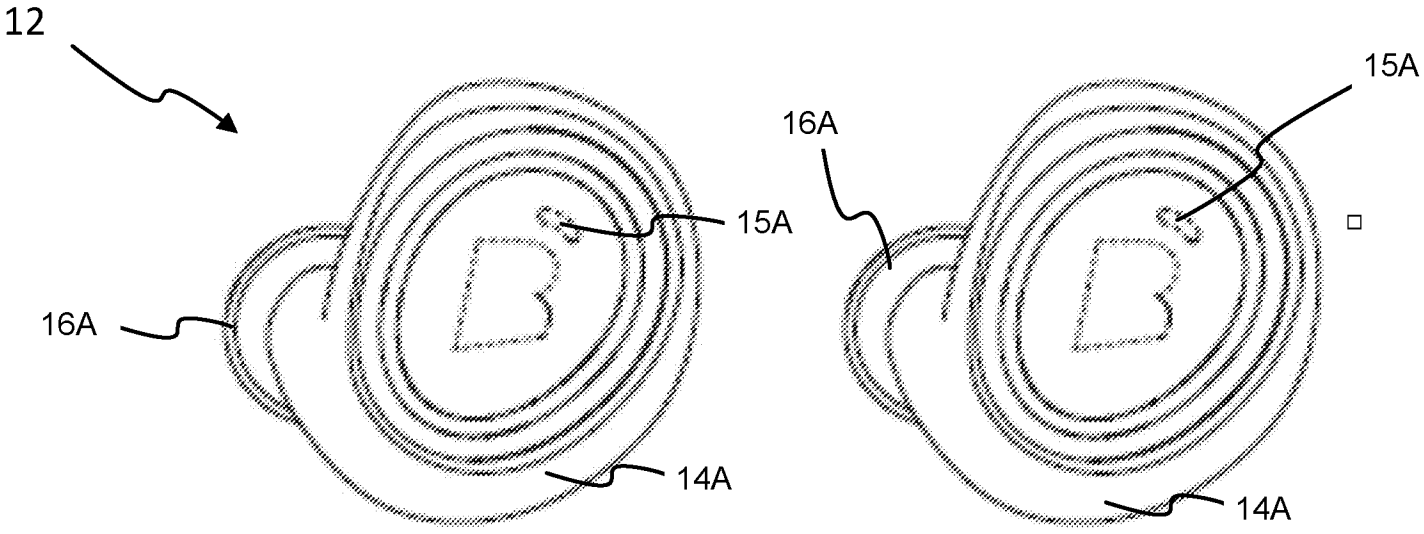
FIG. 4 illustrates a pair of left wireless earpieces.

FIG. 4 illustrates an embodiment of the set of wireless earpieces 12 which includes a pair of left earpieces 12. Each left earpiece comprises earpiece housing 14A. Each left earpiece 12 may be configured to substantially fit within a user's left ear cavity in order to improve audio transparency. Each earpiece housing 14A may be composed of any material or combination of materials providing energy transference and absorbance in response to an applied force to the earpiece.

Microphones 15A are shown on the left earpieces 12A. The microphones are audio input devices. As shown, the microphones 15A may represent over-air microphones. The left earpieces 12 may also include ear-bone or bone-conduction microphones that may be positioned anywhere on the exterior or interior of the earpiece housing 14A. Microphones 15A may be located anywhere on the earpiece housings 14A of the left earpieces 12 and each microphone may be configured to receive one or more voice commands from the user or third party. For example, a user may use a voice command such as, "Synchronize data stream with my earpiece case" in order to establish data synchronization with the smart case 26 in order to upload a song downloaded from a Wi-Fi hotspot to the smart case 26 for future use with another wireless earpiece. Speakers 16A may be configured to communicate warnings or instructions related to the functioning of the wireless earpiece, media or information from another communications hub, media or information received from the smart case 26, or media or information received from another outside electronic device.

The components of the set of wireless earpieces 12 (and the smart case 26) may be electrically connected utilizing any number of wires, contact points, leads, busses, wireless interfaces, or so forth. In addition, the set of wireless earpieces 12 may include any number of computing and communications components, devices or elements which may include busses, motherboards, printed circuit boards, circuits, chips, sensors, ports, interfaces, cards, converters, adapters, connections, transceivers, displays, antennas, and other similar components that may not be specifically shown.

Figure 5:
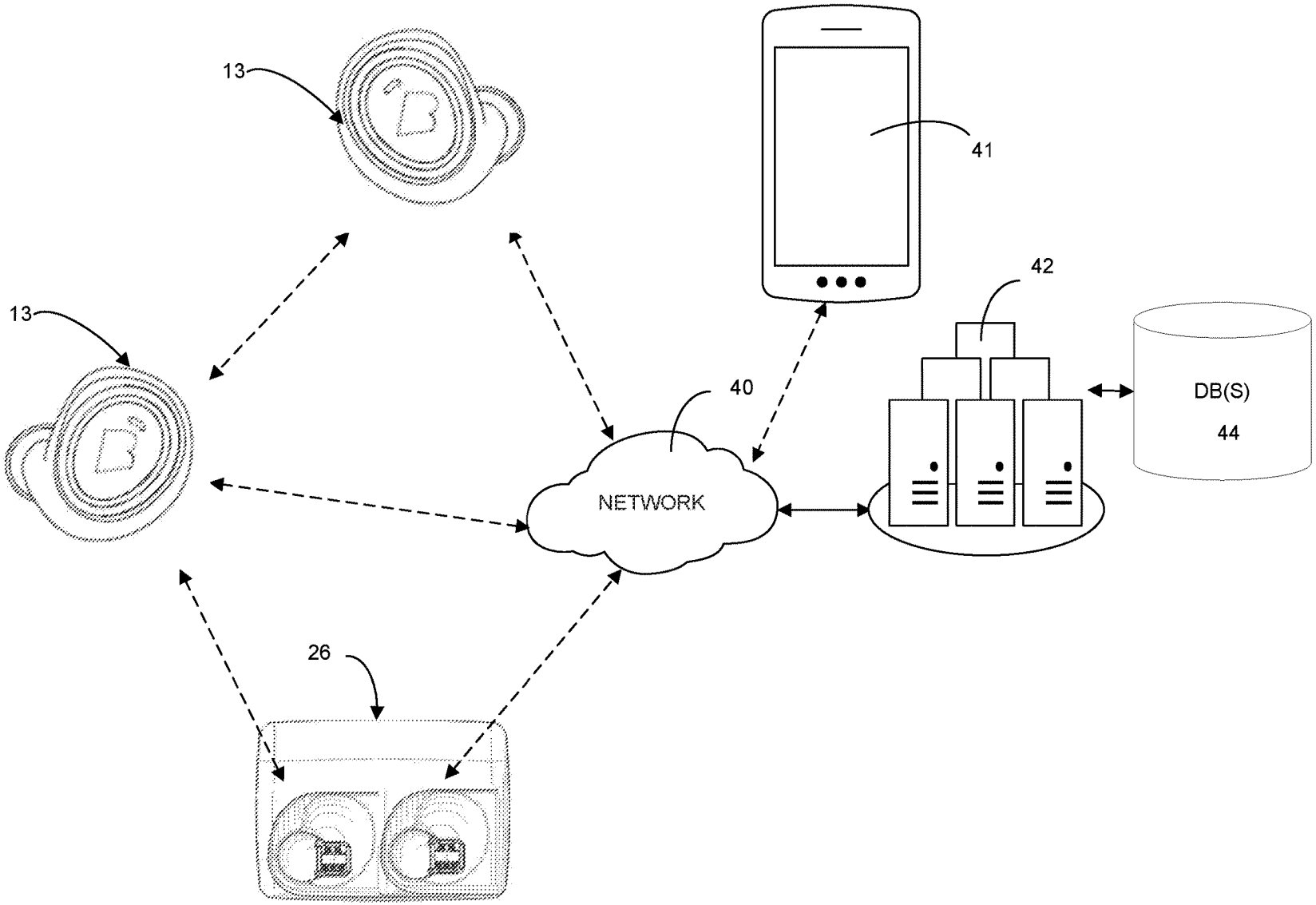
FIG. 5 illustrates a detached wireless earpiece and its relationship to a network.

FIG. 5 illustrates a detached wireless earpiece 13 and its relationship to a network 40. A detached wireless earpiece 13 may be connected to a mobile phone 41, another detached wireless earpiece 13, the smart case 26, or one or more data servers through a network 40 and the detached earpiece 13 may be simultaneously connected to more than one of the foregoing devices. The network 40 may communicate with servers 42. The servers may include one or more databases 44 for storing data and information. The servers 42 may represent a server farm or portions of a cloud network that may be utilized to save data, information, and instructions that may facilitate the implementation of all or portions of the described embodiments.

The network 40 may be the Internet, a Local Area Network, or a Wide Area Network, and the network may comprise one or more routers, one or more communications towers, or one or more Wi-Fi hotspots, and signals transmitted from or received by the detached wireless earpiece 13 may travel through one or more devices connected to the network before reaching their intended destination. For example, if the user wishes to upload a piece of media stored on a mobile phone to the detached wireless earpiece 12, a signal encoding the piece of media may be first uploaded to a router before being subsequently uploaded to the smart case 26, which may determine if the media file being uploaded is either too big or incompatible with the detached earpiece, and, after determining that the media file is suitable for the detached wireless earpiece, uploading the file to the detached earpiece. The smart case 26 may also upload the media file to one or more of the wireless earpieces 12 attached to an electromechanical connector 32 in accordance with an algorithm stored in memory executed by processor of the smart case 26.

In one embodiment, the network 40 may be a personal area network. A personal area network is a network for data transmissions among devices, such as personal computing, communications, camera, vehicles, entertainment, and medical devices. The personal area network may utilize any number of wired, wireless, or hybrid configurations and may be stationary or dynamic. For example, the personal area network may utilize wireless network protocols or standards, such as INSTEON, IrDA, Wireless USB, near field magnetic induction (NFMI), Bluetooth, Z-Wave, ZigBee, Wi-Fi, ANT+ or other applicable radio frequency signals. In one embodiment, the personal area network may move with the user.

Figure 6:
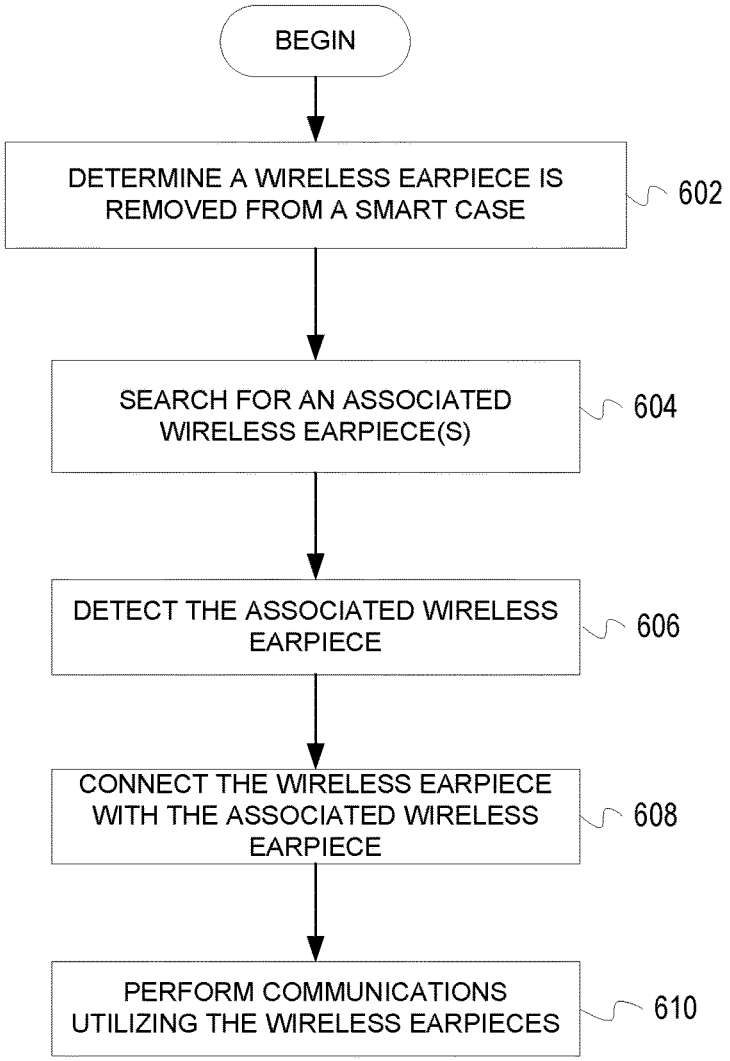
FIG. 6 is a flowchart of a process for connecting wireless earpieces in accordance with an illustrative embodiment.

FIG. 6 is a flowchart of a process for connecting wireless earpieces in accordance with an illustrative embodiment. The process of FIG. 6 may be implemented by one or more wireless earpieces communicating with each other as well as a smart case. The smart case may store as few as a single pair of wireless earpieces or as many as tens or hundreds of wireless earpieces for commercial applications. In one embodiment, a user or users may be able to swap out one of their wireless earpieces at any time because of a low battery, malfunction, cleaning, software update, size change, or so forth. The smart case may store multiple left and right wireless earpieces. In one embodiment, the distinct wireless earpieces may be linked automatically or based on user input.

In one embodiment, the process may begin by determining a wireless earpiece is removed from a smart case (step 602). The determination may be made in response to the wireless earpiece being physically removed from a receptacle (or disconnected from electrical contacts, port, or interface). A magnetic switch may detect the presence, or alternatively, removal of the wireless earpieces from an associated receptacle. The receptacles and associated connectors may be especially configured for a left or right wireless earpiece or may be for utilization of either (e.g., hybrid, ambidextrous, etc.). The determination may also be made in response to the wireless earpieces or an associated transceiver being powered on in response to being touched (e.g., tap, swipe, etc.), a voice command while in the smart case (e.g., turn on wireless earpiece number five), removal from the smart case, or so forth. In one embodiment, a determination that a particular wireless earpiece has been removed is made in response to detecting a link, connection, or signal. For example, the removed wireless earpiece may detect an unpaired wireless earpiece, one that is searching, or an available connection.

Next, the wireless earpiece searches for an associated wireless earpiece (step 604). An associated wireless earpiece is one or more wireless earpieces that a first wireless earpiece may connect to (e.g., a second wireless earpiece, third and fourth wireless earpieces, etc.). In one embodiment, a user may provide input for an already active wireless earpiece to connect to the wireless earpiece removed or detached from the smart case. For example, the user may tap, swipe, gesture, nod, give a voice/audible command, or provide other feedback detected by the wireless earpiece to search for the associated wireless earpiece. The command may be given to an already active or detached wireless earpiece. In another embodiment, the wireless earpieces may automatically search for other wireless earpieces within a specified range or distance threshold.

In one embodiment, the wireless earpieces may have been previously registered or authorized to communicate with a specified set of wireless earpieces. The authorization may be performed utilizing serial numbers, IMEIs, device names, device identifiers, utilization within a single smart case, user preferences, or so forth. For example, the user may utilize an application available through a smart phone to specify that all wireless earpieces connected to a smart case (e.g., in the moment, within a time period, at any time, etc.) are authorized to communicate with each other as sets or individual wireless earpieces. For example, an encryption key may be uploaded to each of the wireless earpieces that may communicate in the future to allow for authorized and secure communications. Different wireless earpieces may have different sets of keys, identifiers, or user preferences allowing for a securing connection/link with other wireless earpieces.

Next, the wireless earpiece detects the associated wireless earpiece (step 606). In one embodiment, a handshake or other exchange may indicate that the wireless earpieces have communicated.

Next, the wireless earpiece connects with the associated wireless earpiece (step 608). As previously disclosed any number of connections, standards, protocols, signals or transceivers may be utilized between wireless earpieces. In one embodiment, a first wireless earpiece (i.e., removed from the smart case) may connect to a second wireless earpiece. In another embodiment, the first wireless earpiece may connect to a second, third, and fourth wireless earpieces that may be worn or utilized by at least two users. In other embodiments, the first wireless earpiece may connect to an unlimited number of wireless earpieces. In one embodiment, a device identifier (e.g., IMEI, serial number, etc.) or other secure identifier may be utilized to ensure that the wireless earpieces may securely communicate. Any number of encryption or pairing processes may be utilized to ensure that only the selected wireless earpieces are connected. For example, biometric identifiers (e.g., voice, skin conductivity, gestures, tactile input, etc.) may be utilized to associate the various communicating wireless earpieces. Although not shown explicitly, the wireless earpieces may include any number of biometric sensors for measuring any number of biometric information and identifiers of one or more users that may wear/utilize the wireless earpieces.

Next, the wireless earpieces perform communications utilizing the wireless earpieces (step 610). The communications may include audible communications, software implementation, application execution, and so forth. For example, a user may utilize a first wireless earpiece (e.g., left wireless earpiece) and a second wireless earpiece (e.g., right wireless earpiece) to perform any number of associated tasks. For example, a team of players, workers, friends, or so forth may communicate utilizing a number of interconnected wireless earpieces.

The process of FIG. 6 may be performed any number of times to exchange wireless earpieces. For example, in response to one left wireless earpiece having a low battery, it may be exchanged with another left wireless earpiece. This process may be repeated any number of times for low battery, damage, poor fit, sweat, blockage, or other purposes.

Therefore, various apparatus, systems, and methods have been shown and described. Although specific embodiments are shown and described, the present invention contemplates numerous variations, options, and alternatives including in structure and function and the present invention is not to be limited to the specific embodiments shown or described herein.

What is claimed is:

1. A system comprising:

a set of wireless earpieces comprising a first wireless earpiece and a second wireless earpiece, wherein each of the first wireless earpiece and the second wireless earpiece is anatomically conformed for wearing in the same ear such that both of the first wireless earpiece and the second wireless earpiece are sized and shaped to operatively fit in a left ear and not a right ear of a user or both the first wireless earpiece and the second wireless earpiece are sized and shaped to operatively fit in the right ear and not the left ear of the user, wherein each of the first wireless earpiece and the second wireless earpiece further comprises:

an earpiece housing;

a speaker disposed within the earpiece housing;

a memory device disposed within the earpiece housing;

a transceiver disposed within each earpiece housing; and a processor disposed within each earpiece housing and operatively connected to the speaker and the transceiver;

wherein the first wireless earpiece is configured to communicate with the second wireless earpiece to synchronize data after the first wireless earpiece is removed from the ear of the user; and wherein the second wireless earpiece is configured to communicate with the first wireless earpiece to synchronize data after the second wireless earpiece is removed from the ear of the user.

2. The system of claim 1, further comprising:

a case comprising:

a case housing comprising a set of receptacles, wherein the set of receptacles substantially define contours having the anatomical conformity of the set of wireless earpieces;

an electromechanical connector disposed within each receptacle, wherein a wireless earpiece of the set of wireless earpieces is coupled to the electromechanical connector; and an energy source disposed within the case housing.

3. The system of claim 2 wherein the case is configured to communicate with the first wireless earpiece to synchronize data after the second wireless earpiece is docked in one of the receptacles of the set of receptacles.

4. The system of claim 2 wherein the case is configured to communicate with the second wireless earpiece to synchronize data after the first wireless earpiece is docked in one of the receptacles of the set of receptacles.

5. The system of claim 2 wherein the case is configured to communicate with the first wireless earpiece to synchronize data after the first wireless earpiece is removed from one of the receptacles of the set of receptacles.

6. The system of claim 2 wherein the case is configured to communicate with the second wireless earpiece to synchronize data after the second wireless earpiece is removed from one of the receptacles of the set of receptacles.

7. The system of claim 1, wherein the first wireless earpiece is docked within a case and the second wireless earpiece is worn by a user.

8. The system of claim 1, wherein a signal is transceived between the second wireless earpiece worn by a user and the first wireless earpiece docked within a case.

9. A pair of wireless earpieces, comprising:

a first wireless earpiece and a second wireless earpiece wherein each of the first wireless earpiece and the second wireless earpiece is anatomically conformed for wearing in the same ear such that both of the first wireless earpiece and the second wireless earpiece are sized and shaped to operatively fit in a left ear and not a right ear of a user or both the first wireless earpiece and the second wireless earpiece are sized and shaped to operatively fit in the right ear and not the left ear of the user, wherein each of the first wireless earpiece and the second wireless earpiece further comprises:

an earpiece housing having an anatomically conformity for the same ear;

a speaker disposed within the earpiece housing;

a memory device disposed within the earpiece housing;

a transceiver disposed within each earpiece housing, wherein a signal is transmitted between the first wireless earpiece and the second wireless earpiece; and a processor disposed within each earpiece housing and operatively connected to the speaker and the transceiver;

wherein the transceiver of the first wireless earpiece is configured to transmit the signal to the transceiver of the second wireless earpiece to synchronize data after the first wireless earpiece is removed from the ear of the user; and wherein the transceiver of the second wireless earpiece is configured to transmit the signal to the transceiver of the first wireless earpiece to synchronize data after the second wireless earpiece is removed from the ear of the user.

10. The wireless earpieces of claim 9, further comprising:

a case comprising:

a case housing comprising a pair of receptacles, wherein the pair of receptacles substantially define contours having the anatomical conformity of the pair of wireless earpieces;

an electromechanical connector disposed within each receptacle, wherein a wireless earpiece of the pair of wireless earpieces is coupled to the electromechanical connector; and an energy source disposed within the case housing;

a processor disposed of within the case housing and operatively connected to the electromechanical connector disposed within each receptacle;

a transceiver disposed of within the case housing and operatively connected to the processor.

11. The pair of wireless earpieces of claim 10, wherein the processor of the case is configured to communicate data received by the transceiver of the case to the first wireless earpiece after the first wireless earpiece is operatively coupled to the electromechanical connector.

12. The wireless earpieces of claim 9, wherein the first wireless earpiece is docked within a case and the second wireless earpiece is worn by a user.

13. The wireless earpieces of claim 9, wherein a signal is transceived between the second wireless earpiece worn by a user and the first wireless earpiece docked within a case.

* * * * *